United States Patent [19]

Graham et al.

[11] 4,188,983

[45] Feb. 19, 1980

[54] WOVEN CONSTRUCTION SYSTEM

[75] Inventors: William T. Graham, Verona; Jean L. Petrick, Helenville; Harold E. Swingley, Jr., Monona, all of Wis.

[73] Assignee: W. T. Rogers Co., Madison, Wis.

[21] Appl. No.: 924,045

[22] Filed: Jul. 12, 1978

[51] Int. Cl.[2] ..... B27J 1/00

[52] U.S. Cl. ..... 139/424; 220/19; 220/83; 217/122; 206/223; 147/48

[58] Field of Search ..... 139/11, 14, 424; 28/143, 151; 220/19, 83; 217/122, 123; 206/223; 147/48; 428/397, 398, 400, 401

[56] References Cited

U.S. PATENT DOCUMENTS

| | | | |
|---|---|---|---|
| 1,207,530 | 12/1916 | Freyer | 139/14 |
| 1,527,422 | 2/1925 | Lloyd | 139/14 |
| 1,773,969 | 8/1930 | Dreyfus et al. | 428/397 |
| 2,488,715 | 11/1949 | Eggl | 217/122 |
| 3,164,947 | 1/1965 | Gaston | 428/401 |

FOREIGN PATENT DOCUMENTS

| | | | |
|---|---|---|---|
| 553431 | 12/1956 | Belgium | 217/122 |
| 442600 | 2/1936 | United Kingdom | 217/122 |

*Primary Examiner*—Henry Jaudon

*Attorney, Agent, or Firm*—Theodore J. Long; Harry C. Engstrom; Nicholas J. Seay

[57] ABSTRACT

A system for making woven articles and kits from which woven articles may be manufactured using the woven construction system are disclosed. The woven construction system includes the use of at least two spaced shaping bands which are interconnected by a plurality of vertical struts which are received within aligned holes in each of the shaping bands. The skeletal structure thus produced by the shaping bands and vertical struts can then be woven by an elongated weaving strip to produce a finished tubular woven construction. Several kits are disclosed which may be assembled into finished woven articles by persons not generally skilled in making woven objects without the use of additional jigs or fixtures.

15 Claims, 20 Drawing Figures

WOVEN CONSTRUCTION SYSTEM

BACKGROUND OF THE INVENTION

1. Field of the Invention

The present invention relates to systems for making woven constructions, and in particular, to woven construction systems suitable for use by hobbyists or home craftsmen.

2. Description of the Prior Art

The prior art contains, of course, many examples of woven baskets and other articles. Examples of woven articles and of systems of weaving such articles are shown in U.S. Pat. Nos. 97,836, 693,911, 882,935, 1,178,924, 1,336,571, 1,475,151 and 1,701,312. It has been a difficulty with such methods of making woven articles that the articles are relatively difficult to manufacture, requiring a skilled craftsmen to fabricate the article. Of the above cited references U.S. Pat. Nos. 1,475,151 and 1,178,924 disclose systems in which a woven web is first manufactured, with the web then being formed into a finished article. It has been a difficulty with such systems that the finished article has unsightly seams or joints.

The prior art contains at least two examples of systems for positioning a set of vertical members which may then be interwoven by a horizontal member. U.S. Pat. Nos. 743,057 and 1,095,820, disclose such systems. It has been a difficulty with such systems, however, that only the bottom ends of the vertical members are positioned and that some sort of jig or fixture is required to position the upper end of the vertical members so that the shape of the finished article may be determined. As such, the methods of making woven articles shown in each of these patents also lends itself more readily to use by only a skilled or experienced craftsmen. Similarly in U.S. Pat. Nos. 1,243,079, 1,243,080, 1,243,081, and 1,243,082 methods of making woven articles are disclosed in which vertical members are temporarily retained at their lower end by a suitable lower annulus, which is a jig to retain the bottom of the vertical members while they are woven. It is a problem with the system disclosed by these patents that a jig is still required upon which the weaving is done, and so this method is suitable only for use at a shop, factory or similar manufacturing establishment. As with all of the systems disclosed in the various patents above, it is unsuitable for use at home by an unskilled hobbyist or craftsman.

SUMMARY OF THE INVENTION

The invention is summarized in that a woven construction of a generally tubular shape includes a pair of spaced shaping bands each formed as a closed generally planar member and each having an odd number of holes formed therein, a plurality of vertical struts of a generally circular cross-section extending between and being received within the corresponding holes in the respective shaping bands, and at least one elongated weaving strip of a generally flattened shape woven in and among the vertical struts, the spaced shaping bands determining the relative orientation and spacing of the vertical struts to thus determine the size and shape of the woven construction.

It is an object of the present invention to provide a system for making woven constructions of a wide variety of types which can be made at home by unskilled hobbyists or craftsmen.

It is another object of the present invention to provide kits for the making of such woven constructions that can be assembled at home by such unskilled hobbyists or craftsmen.

It is yet another object of the present invention to provide such a system and such kits in which the woven constructions are fabricated from materials which are extremely durable, and which are easy to work with.

It is a feature of the present invention in that it enables woven constructions of a wide variety of shapes and sizes to be easily handcrafted without the need for any additional jigs or fixtures.

Other objects, advantages, and features of the present invention will become apparent from the following specification when taken in conjunction with the accompanying drawings.

DESCRIPTION OF THE PREFERRED EMBODIMENT

Figure 1:
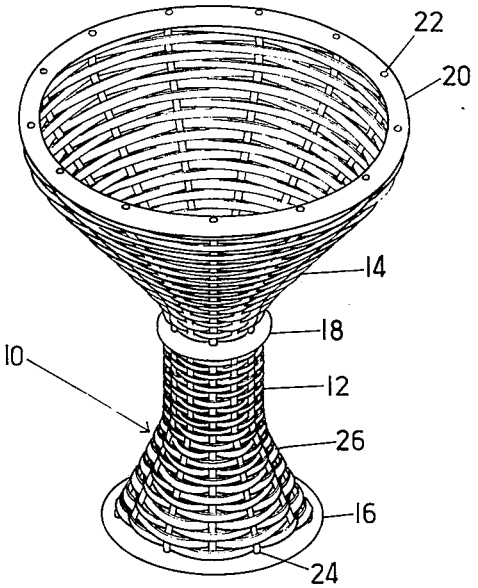
FIG. 1 is a perspective view of a bowl constructed using the woven construction system of the present invention.
Figure 2:
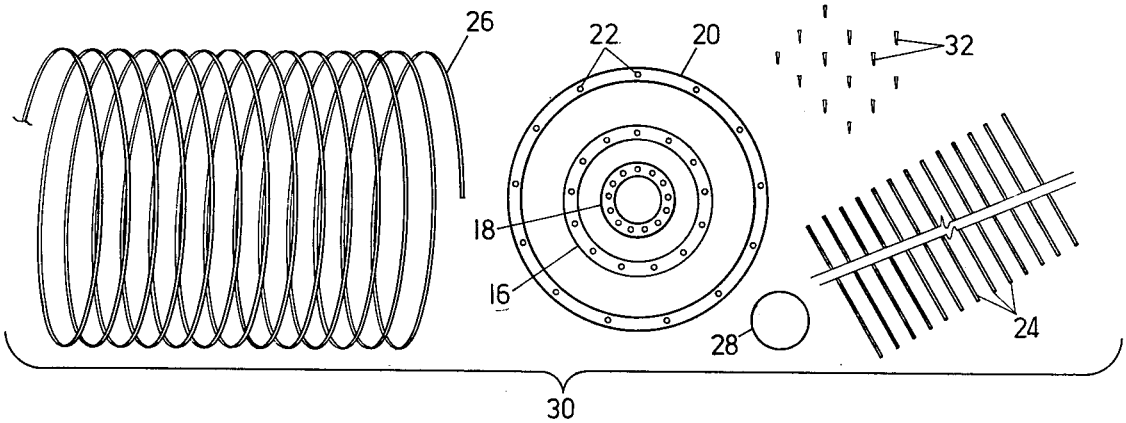
FIG. 2 is a plan view of a kit for making the bowl of FIG. 1.

Shown in FIG. 1 is a bowl, generally indicated at 10, constructed using the woven construction system of the present invention. The bowl 10 is largely formed of two shell sections, 12 and 14, each of a generally tubular shape. As can be seen in FIG. 1, the tubular shell sections 12 and 14 are not perfectly cylindrical, but taper in their cross-sectional size. The term "tubular" as used herein is meant to describe the shape of surfaces, such as the shell sections 12 and 14, which are closed except at their opposite ends and which are generally elongate along the axis extending between those ends but which may vary in both cross-sectional size and shape. The shell section 12 is defined between a pair of spaced structural shaping bands 16 and 18, while the shell section 14 is similarly defined between the shaping band 18 and another spaced structural shaping band 20. Each of the shaping bands 16, 18, and 20 is formed as a generally planar closed ring of thermoplastic material which is sized and formed so as to define the desired cross-sectional size and shape of the bowl 10 at the location of the respective shaping band. The shaping bands 16, 18, and 20 are of varying sizes with the shaping band 20 being the largest, and the shaping band 18 being the smallest. As can be best seen in FIG. 2, showing the component parts of the bowl 10, each of the shaping bands 16, 18, and 20 has provided in it a plurality of holes 22, with the number of holes 22 in each of the shaping bands being variable, provided that the number of holes 22 in each of the shaping bands is odd, and that each of the shaping bands 16, 18, and 20 have an identical number of the holes 22. The preferred number of the holes 22, as shown in FIG. 2, in each of the shaping bands 16, 18, and 20, is 13. Within each of the shaping bands, the holes 22 are oriented in a direction perpendicular to the general plane of the shaping band in which they are formed, so that they will be disposed in the finished bowl 10 parallel to the longitudinal axis of the respective shell sections 12 and 14. Within each of the shaping bands, the holes 22 are spaced equidistant from each other about the circumference of the respective shaping band, so that the holes 22 in all of the shaping bands 16, 18, and 20 may be radially aligned with the holes 22 in each of the other shaping bands.

Figure 3:
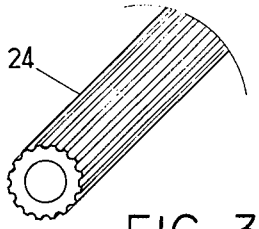
FIG. 3 is an enlarged perspective view of a vertical strut from the bowl of FIG. 1.

Provided extending vertically between the shaping bands 16, 18 and 20 in the bowl 10 of FIG. 1 is a plurality of vertical struts 24. Each one of the struts 24 extends through a respective aligned one of the holes 22 in each of the shaping bands 16, 18, and 20. Preferably, therefore, there are 13 of the struts 24. The struts 24 are also preferably formed of a thermoplastic material or other material of a semi-rigid shape retaining character and yet being sufficiently bendable so that the vertical struts 24 may be manually bended to extend between adjacent shaping bands of different sizes. The vertical struts 24 are each formed of a shape having generally round cross sections and each has longitudinally extending ribs formed extending completely around its circumference, as can be seen by the enlarged view in FIG. 3. The vertical struts 24 may be solid members, but as can be seen in FIG. 3, are preferably hollow. The vertical struts 24 may be supplied in any desired length as may be suitable for the particular project, or may be manufactured and sold in very long lengths which may then be cut to the appropriate size needed for the particular application.

Figure 4:
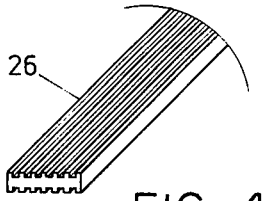
FIG. 4 is an enlarged perspective view of a weaving strip from the bowl of FIG. 1.

Woven in and among the vertical struts 24 in a generally horizontal manner in each of the shell sections 12 and 14 is a respective continuous weaving strip 26. The weaving strip 26 in each of the shell sections 12 and 14 extends continuously in a spiral pattern around the circumference of the respective shell section with the weaving strip 26 extending alternately over and under each of the alternate ones of the vertical struts 24. Although it is preferred that the weaving strip 26 be one uninterrupted strip, the weaving strip 26 may be also formed of one or more separate strips overlapped at their ends. The weaving strip 26 is formed of a thermoplastic material of a generally semiflexible nature, and has a generally rectangular cross-section as shown in FIG. 4. Also as can be seen in FIG. 4 the weaving strip 26 is formed with a plurality of longitudinally extending ribs provided completely about the perimeter of the weaving strip 26. A small planar base disc 28 is also included in the bowl 10, and is located atop the shaping band 18 on the interior of the bowl 10 to close the bottom of the receptacle formed by the upper shell section 14.

Figure 5:
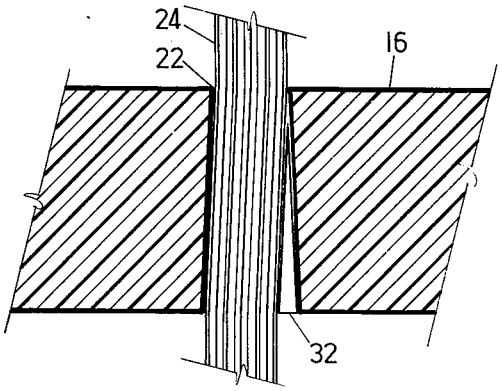
FIG. 5 is an enlarged cross-sectional view of a hole in one of the shaping bands in the bowl of FIG. 1.

The constructional elements required to construct the bowl 10 are supplied in the form of a kit 30 containing all of the parts illustrated within the reference numeral 30 in FIG. 2. The parts of the kit 30 as shown in FIG. 2 have the same reference numeral as the respective parts of the finished bowl 10. In constructing the bowl 10 from the kit 30, it is most convenient to begin with the lowermost shaping band 16. The lowermost ends of the 13 vertical structs 24 are first inserted one at a time into the respective holes 22 in the shaping band 16. The struts 24 may be secured in place in the holes 22 by appropriate gluing, heat sealing, or other similar technique, but are preferably each wedged into the holes 22 with one of a plurality of wedges 32 supplied with the kit 30. As can be seen in the enlarged view of FIG. 5, each of the holes 22 within each of the shaping bands, here the shaping band 16, is formed of a tapered shape, larger at one end than the other. One end of the vertical strut 24 is first inserted into the hole 22, and then one of the wedges 32 is jammed into the wider end of the hole 22 to firmly wedge the vertical strut 24 in place inside of the hole 22. This procedure is equally applicable at either of the ends of the vertical struts 24 at the respective ends of the bowl 10. To secure the most stable joint, it is, of course, preferred that the wedge 32 be inserted through the larger of the two ends of the hole 22.

Once the vertical struts 24 are all attached to the shaping band 16, the shaping band 18 is then threaded onto each of the vertical struts 24 with the struts 24 being received in the respective holes 22 in the shaping band 18. Since, of course, the shaping band 18 is smaller than the shaping band 16, this will cause the vertical struts 24 to bend inwardly. To facilitate this bending, each of the vertical struts 24 in the shaping band 16 may be pre-bent inwardly before the shaping band 18 is threaded onto the vertical struts 24. The shaping band 18 may be temporarily held in place by bending of the struts 24 until it is permanently restrained in its movement by the weaving of the weaving strip 26. This forms, in effect, a skeletal structure for the shell section 12, with the relative spacing and orientation of the vertical struts being determined by the shaping bands 16 and 18. The weaving of this skeletal structure may begin using the weaving strip 26 which, starting at the bottom of the vertical struts 24 adjacent the shaping band 16, is woven under and over adjacent ones of the vertical struts 24 continuously around the periphery of the shell section 12. As the weaving of the weaving strip 26 continues around the periphery of the shell section 12, each sequential pass of the weaving strip 26 is placed adjacent to the immediately preceding pass. The fact that there are an odd number of holes 22 ensures that on two adjacent succeeding passes the weaving strip 26 will pass both over and under any one vertical strut 24. When the weaving of the weaving strip 26 reaches the bottom edge of the shaping band 18, the weaving strip 26 is cut, and the loose end of the weaving strip 26 is tucked underneath the next adjacent vertical strut 24.

The shell section 14 is constructed in a similar manner, the shaping band 20 first being threaded onto the vertical struts 24, after the vertical struts 24 are bent outwardly from the shaping band 18, and the shaping band 20 is then secured in place by insertion of the wedges 32. A continuous weaving strip 26 is woven in and among the vertical struts 24, beginning adjacent the shaping band 18 and continuing uninterruptedly until the weaving strip 26 is adjacent the shaping band 20. The tops of any of the vertical struts 24 which may extend above the shaping band 20 are cut flush with the top of the shaping band 20 and the base disc 28 is placed inside of the shell section 14 and secured, preferably by gluing, atop the shaping band 18 to complete the bowl 10.

Figure 6:
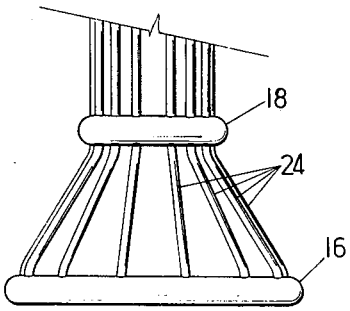
FIG. 6 is a side elevation view of a skeletal structure formed during the making of the bowl of FIG. 1.

The woven construction system of the present invention as incorporated in the bowl 10 provides several significant advantages over previously known weaving systems. Firstly, and most importantly, it allows woven articles such as bowls, baskets, cups and vases to be constructed much more easily, and with less ancillary equipment, than was heretofore possible. This advantage arises because of the provision for the spaced shaping bands 16, 18, and 20, which allow a skeletal frame for each shell section to be assembled before the actual weaving with the weaving strip 26 begins, as illustrated in FIG. 6. Previously when making woven articles of this type one of two elements was required. Either there had to be a jig or fixture to hold the vertical elements in the proper spaced relation while the weaving was done, or the person doing the weaving had to be a skilled craftsman who could position those elements as he or she progressed in the weaving. The need for either of these elements is obviated by the woven construction system of the present invention which allows woven constructions, such as the bowl 10, to be fabricated by an unskilled or novice person without the need for any other jigs or fixtures. The diameter and shape of the article thus produced can also be pre-selected and controlled with great certainty since the spaced shaping bands 16, 18, and 20 determine the exact size and shape of the bowl 10 at their respective locations. And because the shaping bands may be provided in a wide variety of shapes and sizes, woven articles of an even wider variety of shapes and sizes may be produced.

This advantage in being easy to construct makes the woven construction system of the present invention particularly adapted for packaging in kits which may be assembled at home by a home hobbyist. Kits for the hobbyist to make woven articles have not been widely used or accepted in the past because of the inherent difficulty and skill required in making woven articles from a kit. The woven construction system of the present invention allows such kits to be used and readily assembled by a user who is not particularly skilled. Furthermore, simply by varying the number, size, and shape of the shaping bands in the kit, kits for a wide variety of woven articles may be readily packaged for assembly.

It is thus possible by merely varying the sizes, positions and number of the shaping bands in the article to be woven to produce a wide variety of different woven articles and kits for making these articles, incorporating the woven construction systems of the present invention. As examples of this feature, shown in FIGS. 6, 8, and 11 respectively are a pencil cup 34, a plant pot cover 36, and a basket 38 all fabricated using the woven construction system of the present invention.

Figure 7:
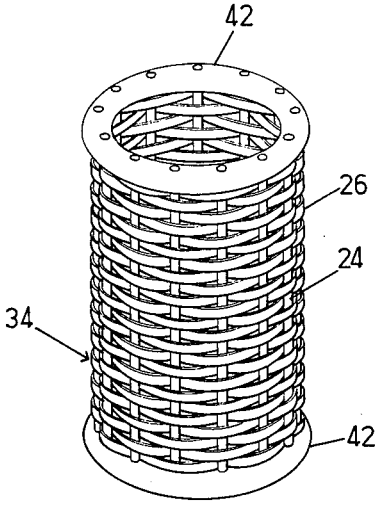
FIG. 7 is a pencil cup constructed using the woven construction system of the present invention.

The pencil cup 34 is assembled from a pencil cup kit 40 as shown in FIG. 7. The pencil cup kit 40 includes seven long vertical struts 24, a pair of identical shaping bands 42, a weaving strip 26, a base disc 44, and a plurality of wedges 32. To assemble the pencil cup 34 from the kit 40, the vertical struts 24 are first cut in half so that there are 13 of the vertical struts 24, with one spare, and the ends of the vertical struts 24 are first secured in the holes 22 in one of the shaping bands 42 by use of the wedges 32. The other shaping band 42 is then threaded onto the vertical struts 24 and also secured to them by insertion of the wedges 32. The skeletal structure of the pencil cup thus produced is then woven with the weaving strip 26 and the cup base disc 44 is inserted to rest on the top of the bottom shaping band 42 inside the woven shape thus made to complete the pencil cup 34.

Figure 8:
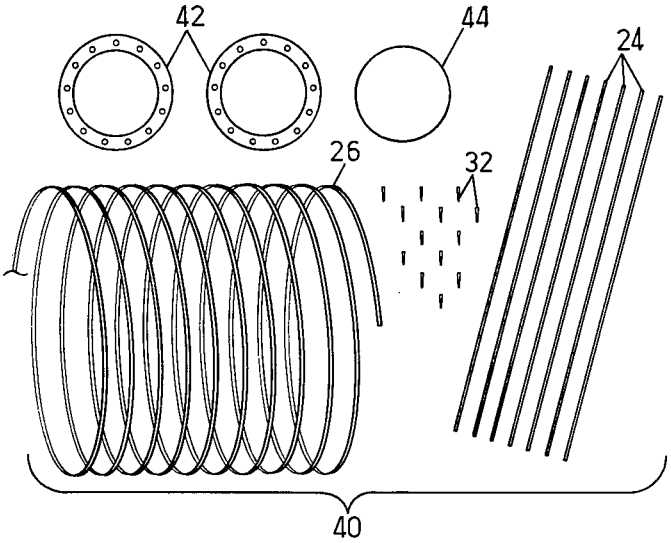
FIG. 8 is a plan view of a kit for making the pencil cup of FIG. 7.
Figure 9:
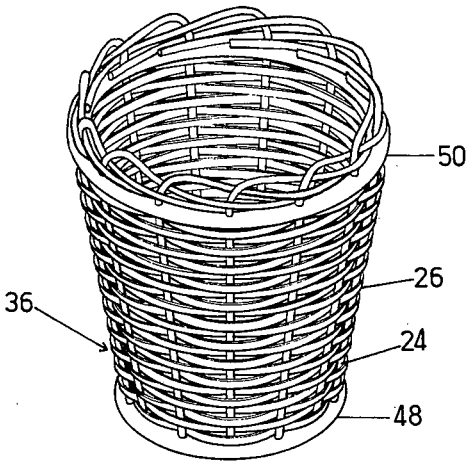
FIG. 9 is a plant pot cover constructed using the woven construction system of the present invention.
Figure 10:
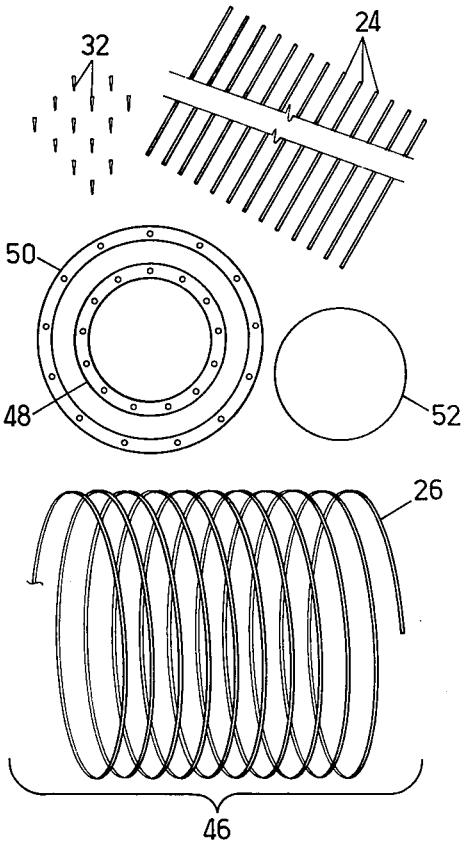
FIG. 10 is a plan view of a kit for making the plant pot cover of FIG. 9.
Figure 11:
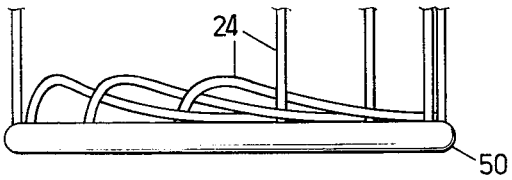
FIG. 11 is a side elevation view of the top detail during the construction of the plant pot cover of FIG. 9.

The plant pot cover 36 as shown in FIG. 8 is assembled from a plant pot cover kit 46 as shown in FIG. 9. The plant pot cover kit 46 includes thirteen of the vertical struts 24, a smaller and a larger shaping band 48 and 50 respectively, a weaving strip 26, a base disc 52 and a plurality of wedges 32. To assemble the plant pot cover 36 from the kit 46, the ends of the vertical struts 24 are first inserted in the holes 22 in the smaller shaping band 48 and are secured in place by the wedges 32. The larger shaping band 50 is then threaded over the vertical struts 24 and, after the wedges 32 are inserted to lock the shaping band 50 in place, the resultant skeletal structure is woven with the weaving strip 26 to form the general tubular shape of the plant pot cover 36. To finish the plant pot cover 36, the base disc 52 is placed therein on top of the lower shaping ring 48 and the tops of the vertical struts 24 which extend above the shaping band 50 are bent over and woven through the adjacent vertical struts 24 as shown in FIG. 11. The interweaving of the tops of the vertical struts 24 may obviate the need for the wedges 32 in the top shaping band 50, and, if desired, a similar woven trim could be used at the bottom edge of the plant pot cover 36 to obviate the need for any of the wedges 32. It is also envisioned that the plant pot cover kit 46 could be supplied with a flanged pan (not shown) rather than the base disc 52 so that the base of the plant pot cover 36 would hold any water that might overflow from a plant pot therein.

Figure 12:
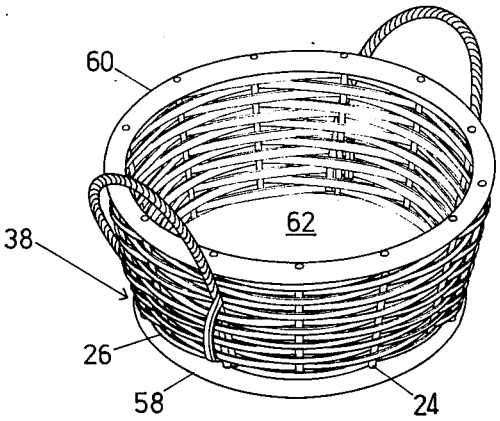
FIG. 12 is a basket constructed using the woven construction system of the present invention.
Figure 13:
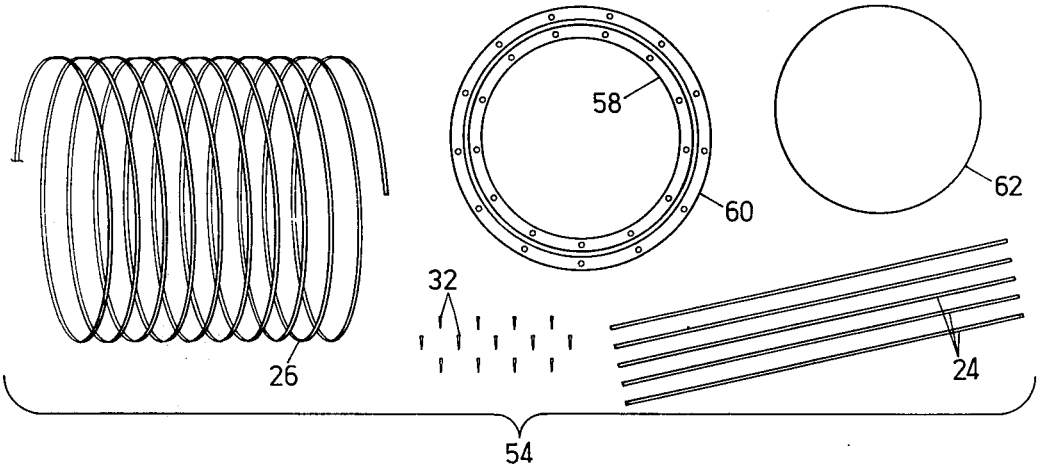
FIG. 13 is a plan view of a kit for making the basket of FIG. 12.

The basket 38 as shown in FIG. 11 is assembled from a basket kit 54 as shown in FIG. 12. The basket kit 54 includes a pair of shaping rings 58 and 60, five long vertical struts 24, an elongated weaving strip 26, a plurality of wedges 32, and a base disc 62.

To assemble the basket 38 from the basket kit 54, the long vertical struts 24 are each cut into at least three equal lengths so that there are at least 13 equal length vertical struts 24, and the vertical struts 24 then each have one end inserted into a hole 22 in the smaller shaping ring 48 where they are secured by wedges 32. The larger shaping ring 50 is then threaded over the vertical struts 24 and wedges 32 are inserted into each of the holes 22 in the shaping ring 50 to secure it in place. Then the skeletal structure thus produced is woven with the weaving strip 26 to produce the tubular shape of the basket 38. To form the handles for the basket 38, a pair of spare lengths of the vertical struts 24 are bent in a horseshoe shape and inserted so that the ends of each length is received in the woven pattern next to one of the other vertical struts 24 already woven in the basket. The handles are then wrapped with a length of the weaving strip 26 and the base disc 62 is placed inside the structure on the shaping ring 48 to complete the basket 38.

Another advantageous feature of the woven construction system of the present invention is the provision for the longitudinally extending ribs on both the vertical struts 24 and the weaving strip 26. These ribs on these two elements provide a frictional resistance to relative movement between these two elements in two perpendicular directions. This frictional resistance is also felt during the weaving process and gives the hobbyist a tactile feel more akin to that experienced during wicker or cane weaving than would otherwise be the case. Since the ribs provide this frictional force in two perpendicular directions, the total stiffness of the woven article is greatly increased than would otherwise be the case. This increase in stiffness can be perceived by the person assembling the woven article as the skeletal structure formed by the vertical struts and shaping bands becomes progressively more stiff as successive passes of the weaving strip are made.

Figure 14:
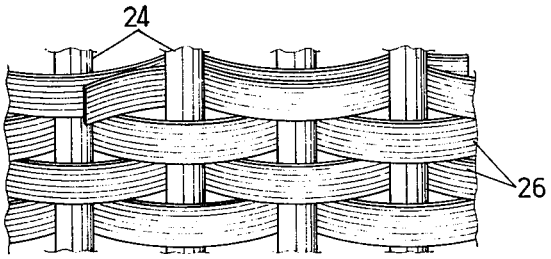
FIG. 14 is a side elevation view of a portion of a woven construction according to the present invention wherein a weaving strip is overlapped.

An additional advantageous feature provided by the ribs on the weaving strip 26 is that successive lengths of the weaving strip 26 may be overlapped, as is illustrated in FIG. 14. When the end of a length of the weaving strip 26 is reached in the middle of a section of a woven article, the end of the succeeding length of the weaving strip 26 may be overlapped with the end of the first length as it is woven between the last few vertical struts 26. Because of the ribs on the lengths of the weaving strip 26, the two ends remain in place, and neither piece slips laterally outward as they would otherwise tend to do.

As stated, it is preferred that all of the shaping bands, the vertical struts and the weaving strips be constructed from thermoplastic material. It has been found that certain specific materials may be preferable for each of these three components. Because the shaping rings are intended to be rigid and shape-retaining, it has been found that polystyrene materials are particularly suited for their construction. It is an advantage of such materials in that it is relatively easy to form a grained or textured surface on the shaping bands when these materials are used to enhance the ornamental or decorative character of the woven article. The vertical struts must be bendable, yet still retain a certain amount of rigidity, and it has been found that a mix of 50 percent polypropylene and 50 percent high density polyethylene provides these characteristics. The weaving strips must be more flexible, and yet must also be strong and durable, and it has been found that polyvinyl chloride materials are suited for this purposes. It is also envisioned that other thermoplastic materials as those described above may be used depending on the desired combination of stiffness and durability in the finished article. It is necessary in any event, however, that the materials of the weaving strips and the vertical struts be compatable ones. With some materials it has been found that the materials adhere to each other and interfere with the weaving of the weaving strip 26. The materials described herein for the weaving strip and the vertical struts are suitably compatable materials.

It is also envisioned that the vertical struts 24 may be secured in the holes 22 in the appropriate spacing bands by other means than the wedges 32. It is envisioned that an adhesive material may be used to glue the vertical struts in place by mechanical bonding. At the opposite ends of the article woven, the ends of the vertical struts 24 protruding beyond the end shaping band could be deformed, such as by heat treating, to form enlarged portions which could not pass back through the holes 22. Alternatively, the ends of the struts could be interwoven, as shown herein in the plant pot cover 36, so that they would not be free to pass back through the holes 22. It is further envisioned that if it is desired that the vertical struts and the shaping bands be formed of the same material, that the material of these two components could be slightly and temporarily melted at the joints therebetween, either by heat melting or by chemical solvent, so that the materials of the two components could be permanently fused together.

Figure 15:
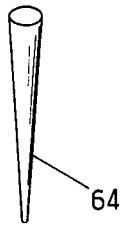
FIGS. 15–17 show an alternative method of fixing the ends of the vertical struts in the shaping bands.
Figure 16:
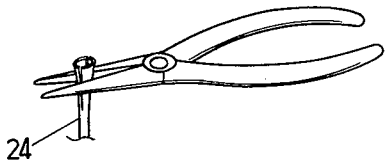
Figure 17:
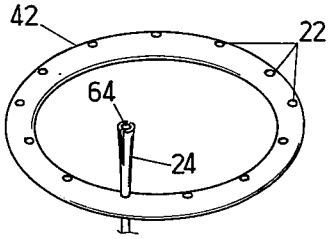

Shown in FIGS. 15–17 is an alternative method of fixing the ends of the vertical struts 24 in the holes 22 in the shaping bands, with the method being illustrated on the lower shaping band 42 from the pencil cup kit 40. A rounded conical wedge 64, as shown in FIG. 15, formed of molded thermoplastic material is used in this alternative method. First the end of the vertical strut 24 is inserted through the appropriate hole 22 in a shaping band and then the end of the strut 24 is fractured by crushing it between a pair of pliers or other compressive tool, as shown in FIG. 16. Then the wedge 64 is inserted into the split end of the vertical strut 24, as shown in FIG. 17, and the end of the strut 24 is pulled into the hole 22 with the wedge 64 secured within the end of the strut 24 securing the strut 24 in position in the hole 22. This procedure is performed so that the wedge 64 is drawn into the hole 22 from its larger end.

It is also envisioned that the vertical struts 24 may not always be completely vertical. On occasion, for instance, it may be desirable for a pair of the struts 24 to either twist around each other or to pass through non-aligned holes 22 in adjacent shaping bands for decorative effect.

It is, of course, necessary that each of the shaping bands have an odd number of holes 22 therein so that the weaving strip 26 passes successively over and under each particular vertical strut 24 in successive passes about the article being woven. While it has been found that shaping bands with 11 and 15 of the holes 22 are usable in the woven construction system of the present invention, it has been found that the use of 13 of the holes 22 in each shaping band, for shaping bands between 2 and 8 inches in diameter, is the most suitable for woven constructions according to the present invention. Smaller numbers of the holes 22 may make the finished article appear multi-sided, rather than rounded, although the use of a fewer number of the holes 22 may be preferred where smaller shaping bands are used. The use of a larger number of the holes 22 makes the vertical struts too close together and difficult to weave in the smaller shaping band sizes, but a larger number of the holes 22 may be preferred where the article to be constructed includes no small shaping bands.

It is possible, in one circumstance, to include shaping bands having different numbers of the holes 22 in a single article, and this circumstance arises where shaping bands of very large sizes are to be used in conjunction with much smaller ones. The larger shaping bands may be provided with three times as many of the holes 22, i.e., 39 of them if the smaller band has 13, and a vertical strut would be inserted in each of the holes 22 in the larger shaping band. Only one of each three of the struts so inserted would also be inserted in the smaller shaping band, but when the article is woven, this fact would not be readily apparent from the appearance of the article. It is necessary for the larger band to have three times as many of the holes 22, rather than twice as many, in order that the number of holes remain odd.

It is envisioned that shaping bands of different shapes may also be used, such as ovals, ellipses or even squared or rectangular shaping bands. It is necessary, however, that the shaping band be of a closed, or continuous shape so that the weaving may be continuous.

Figure 18:
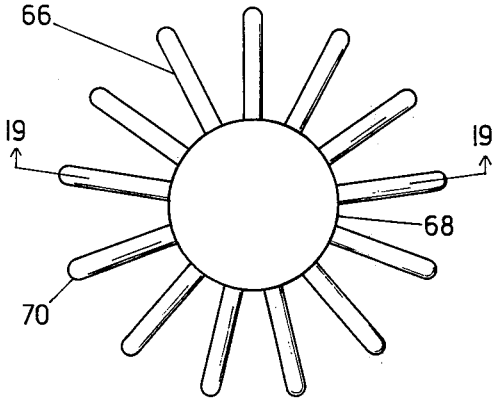
FIG. 18 is a top view of a weaving hub.
Figure 19:
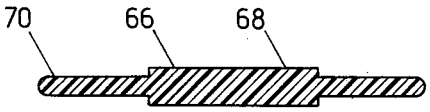
FIG. 19 is a cross-sectional view of the hub of FIG. 18.
Figure 20:
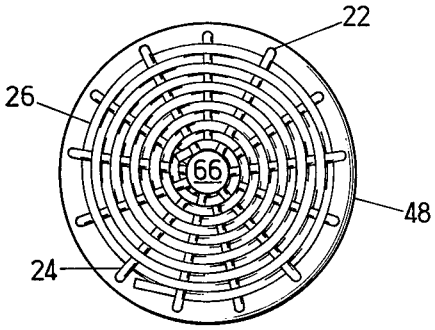
FIG. 20. is a top view of the weaving hub positioned inside the shaping band.

Shown in FIGS. 18 and 19 is a weaving hub 66 which is usable with any of the woven constructions of the present invention to close one or both ends of a tubular structure. The weaving hub 66 includes a solid disc-shaped central portion 68 from which thirteen regularly spaced spokes 70 extend outwardly. Each of the spokes 70 is sized so as to fit tightly within the end of one of the hollow weaving struts 24. The use of the weaving hub 66 is illustrated in FIG. 20 with respect to the bottom of the plant pot cover 36. As shown in FIG. 20, which is from the bottom of the pot cover 36, the vertical struts 24 all extend through the lower shaping band 48 and are bent inward across the bottom of the pot cover 36. The end of each of the vertical struts 24 is received over one of the spokes 70 of the weaving hub 66 which is centrally positioned inside the shaping band 48. The resultant framework is then woven with a weaving strip 26 to complete the flat bottom of the plant pot cover 36 as shown in FIG. 20. The weaving hub is, of course, usable with any of the other woven constructions disclosed herein to form a flat, closed top or bottom for any of them in a similar manner.

It is understood that the subject invention is not limited to the particular construction and arrangement of parts disclosed and illustrated herein, but embraces all such modified forms thereof as come within the scope of the following claims.

I claim:

1. A woven construction of a generally tubular shape comprising:

a. at least two spaced, closed shaping bands each having an odd number of holes formed in it;

b. a plurality of struts extending between and being received within the corresponding holes in each of the shaping bands, each of the struts being formed from thermoplastic material into a generally circular cross-sectional shape and each of the struts having a plurality of longitudinally extending ribs provided on its surface about its periphery;

c. at least one elongated weaving strip woven continuously in and among the struts, the weaving strip being formed from thermoplastic material into a generally flattened shape and having a plurality of longitudinally extending ribs provided on its surface about its periphery, the ribs on the weaving strip and the ribs on the struts serving to add stiffness to the woven construction; and d. the spaced shaping bands determining the relative orientation and spacing of the struts to thus determine the size and shape of the woven construction.

2. A woven construction as claimed in claim 1 wherein the struts are fixedly secured in the holes in the shaping bands.

3. A woven construction as claimed in claim 2 wherein wedges are also inserted in the holes in the shaping bands to fix the vertical struts in position in the holes.

4. A woven construction as claimed in claim 2 wherein the holes in the shaping bands are tapered in size and the wedges are inserted in the larger ends of the holes.

5. A woven construction as claimed in claim 4 wherein the wedge is received in the hole in the shaping band outside of the strut.

6. A woven construction as claimed in claim 4 wherein the struts are hollow and each wedge is received in the hole in the shaping band inside of the respective strut.

7. A woven construction as claimed in claim 1 wherein a weaving hub is provided inside one of the shaping bands at one end of the woven construction, and wherein each of the struts is bent inward from the shaping band to the weaving hub to form a flat end of the construction.

8. A woven construction as claimed in claim 7 wherein the weaving hub includes a disc-shaped central portion from which a plurality of regularly spaced spokes extend, and wherein one of the struts is received over each one of the spokes.

9. A kit for making a woven construction capable of being assembled into the woven construction by an unskilled person without the use of additional jigs or fixtures, the kit comprising the combination of;

a. a plurality of elongated struts adapted to being held in spaced vertical orientation;

b. at least one elongated weaving strip adapted to being woven in and among the vertical struts in a generally horizontal manner;

c. at least two shaping bands of a generally closed planar shape, each of the shaping bands having an odd number of holes formed in it and each shaping band being adapted to receiving fixedly in the holes therein the struts, the shaping bands being thus adapted to retain and fix the struts to determine the relative spacing and orientation of the struts to thus determine the size and shape of the woven construction; and d. a plurality of wedges adapted for use in wedging the struts in place in the holes in the shaping bands to thus form a skeletal structure which is capable of retaining its shape so that it can be woven with the weaving strip to form the woven construction.

10. A kit for making a woven construction as claimed in claim 9 wherein the kit further includes a base disc sized to fit inside the woven construction atop one of the shaping bands to close one end thereof.

11. A kit for making a woven construction as claimed in claim 9 wherein each of the struts has a circular cross-sectional shape.

12. A kit for making a woven construction as claimed in claim 11 wherein each of the struts has a plurality of longitudinally extending ribs formed on its provided about its periphery.

13. A kit for making a woven construction as claimed in claim 9 wherein the weaving strip is provided with longitudinally extending ribs formed on it about its periphery.

14. A method of making a woven construction comprising the steps of:

a. inserting the ends of a plurality of elongated struts into holes formed in a shaping band of a closed planar shape;

b. threading another shaping band of a closed planar shape over the struts so that the struts are received in holes formed therein to thus form a skeletal structure of the woven construction;

c. inserting a wedge into each of the holes in the shaping bands to wedge the struts securely in place therein so that the skeletal structure will retain its shape; and d. weaving a weaving strip in and among the struts of the skeletal structure to form the woven construction.

15. A method of making a woven construction as claimed in claim 14 further including the step of inserting a base disc inside the woven construction adjacent one of the shaping bands to close one end of the construction.

* * * * *